US009652915B2

(12) United States Patent
Howe et al.

(10) Patent No.: US 9,652,915 B2
(45) Date of Patent: May 16, 2017

(54) SYSTEM AND METHOD HAVING BIOMETRIC IDENTIFICATION INTRUSION AND ACCESS CONTROL

(71) Applicant: HONEYWELL INTERNATIONAL INC., Morristown, NJ (US)

(72) Inventors: Steven J Howe, Massapequa, NY (US); Kwong Wing Au, Bloomington, MN (US); Sharath Venkatesha, Minnetonka, MN (US); Ryan Andrew Lloyd, Burnsville, MN (US); Kenneth L. Addy, Massapequa, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/581,431

(22) Filed: Dec. 23, 2014

(65) Prior Publication Data

US 2015/0248798 A1 Sep. 3, 2015

Related U.S. Application Data

(60) Provisional application No. 61/946,283, filed on Feb. 28, 2014.

(51) Int. Cl.
*G07C 9/00* (2006.01)
*G08B 25/00* (2006.01)

(52) U.S. Cl.
CPC ..... *G07C 9/00158* (2013.01); *G08B 25/008* (2013.01); *G07C 2209/02* (2013.01); *G07C 2209/14* (2013.01)

(58) Field of Classification Search
None
See application file for complete search history.

(56) References Cited

U.S. PATENT DOCUMENTS

| | | | | |
|---|---|---|---|---|
| 4,449,189 | A | 5/1984 | Feix et al. | |
| 5,761,329 | A | 6/1998 | Chen et al. | |
| 6,023,688 | A * | 2/2000 | Ramachandran | G06Q 20/042 705/40 |
| 6,219,640 | B1 | 4/2001 | Basu et al. | |
| 2006/0067573 | A1 * | 3/2006 | Parr | G06K 9/00275 382/154 |
| 2008/0247606 | A1 | 10/2008 | Jelinek | |

(Continued)

FOREIGN PATENT DOCUMENTS

| | | | |
|---|---|---|---|
| CN | 1971630 | A | 5/2007 |
| CN | 101403886 | A | 4/2009 |

(Continued)

OTHER PUBLICATIONS

Partial European search report for corresponding EP application 15155276.7, dated Jul. 10, 2015.

(Continued)

*Primary Examiner* — Daniell L Negron
(74) *Attorney, Agent, or Firm* — Husch Blackwell LLP

(57) ABSTRACT

An apparatus and method are provided that include biometric identification intrusion and access control. The apparatus features a monitoring system, a visual input device, and an audible input device. The visual and audible input devices are coupled to control circuits of the monitoring system, which can implement an authentication process responsive to both visual and audile inputs.

16 Claims, 3 Drawing Sheets

(56) References Cited

U.S. PATENT DOCUMENTS

| | | | | |
|---|---|---|---|---|
| 2008/0252412 | A1* | 10/2008 | Larsson | B60R 25/25 340/5.2 |
| 2009/0189736 | A1* | 7/2009 | Hayashi | G06F 21/32 340/5.81 |
| 2013/0223696 | A1 | 8/2013 | Azar et al. | |
| 2014/0016835 | A1* | 1/2014 | Song | G10L 17/06 382/118 |

FOREIGN PATENT DOCUMENTS

| | | | |
|---|---|---|---|
| EP | 0 779 602 | A2 | 6/1997 |
| WO | WO 2008/124382 | A1 | 10/2008 |

OTHER PUBLICATIONS

Extended European search report for corresponding EP patent application 15155276.7, dated Nov. 5, 2015.
Examination report from corresponding CA patent application 2,882,680 dated Jun. 7, 2016.
First Office Action and Search Report for corresponding CN patent application 201510172119.1, dated Dec. 19, 2016.
English-language translation of First Office Action and Search Report for corresponding CN patent application 201510172119.1, dated Dec. 19, 2016.
English-language translation of Abstract for CN patent application 1971630 A, dated May 30, 2007.
English-language translation of Abstract for CN patent application 101403886 A, dated Apr. 8, 2009.

* cited by examiner

SYSTEM AND METHOD HAVING BIOMETRIC IDENTIFICATION INTRUSION AND ACCESS CONTROL

CROSS REFERENCE TO RELATED APPLICATION

This application claims the benefit of U.S. Provisional Patent Application Ser. No. 61/946,283 filed Feb. 28, 2014, the entirety of which is hereby incorporated by reference as if fully set forth herein.

FIELD

The subject invention pertains generally to a security detection and control system and, more particularly, to a system and method that can detect, process, and respond to a combination of visual and audible input.

BACKGROUND

In the field of physical security, disarming an alarm system typically involves a user keying in a pre-assigned 4 digit PIN code upon entry into a secured home, apartment, or place of business. Unfortunately, this common act is very often a source of false alarms and customer frustration stemming from miskeying the PIN, double key entries on a sticky/intermittent key pad, or juggling or dropping articles that may be in hand while entering the doorway. To make matters worse, the user can be trying to complete this operation while under strict time pressure to deactivate the alarm system before a predetermined entry timer elapses, such as, for example, 30 seconds, and an alarm is called to the central station. Accordingly, there is a need in the art for an opportunity to make the disarming process easier and less stressful and to provide an improved user experience while preserving total system security by only allowing authorized individuals to disarm the system.

What is needed is the equivalent of a "Good Guy/Bad Guy Detector" at the door that can facilitate the disarming of an alarm system while preserving the correct authorization of individuals. Such detector, which can be part of an overall alarm system, should ideally work by using unique physical characteristics of an individual (biometrics based) without having to possess a "key fob," access card, or other ID token that can be lost or stolen. According to such detection, hands free operation could be maintained to allow articles or packages to be carried or gloves to be worn during cold weather. It would be further advantageous if such an entry and authorization process were quick and convenient and did not interfere with a user's ingress or egress at the door.

DETAILED DESCRIPTION

Figure 1:
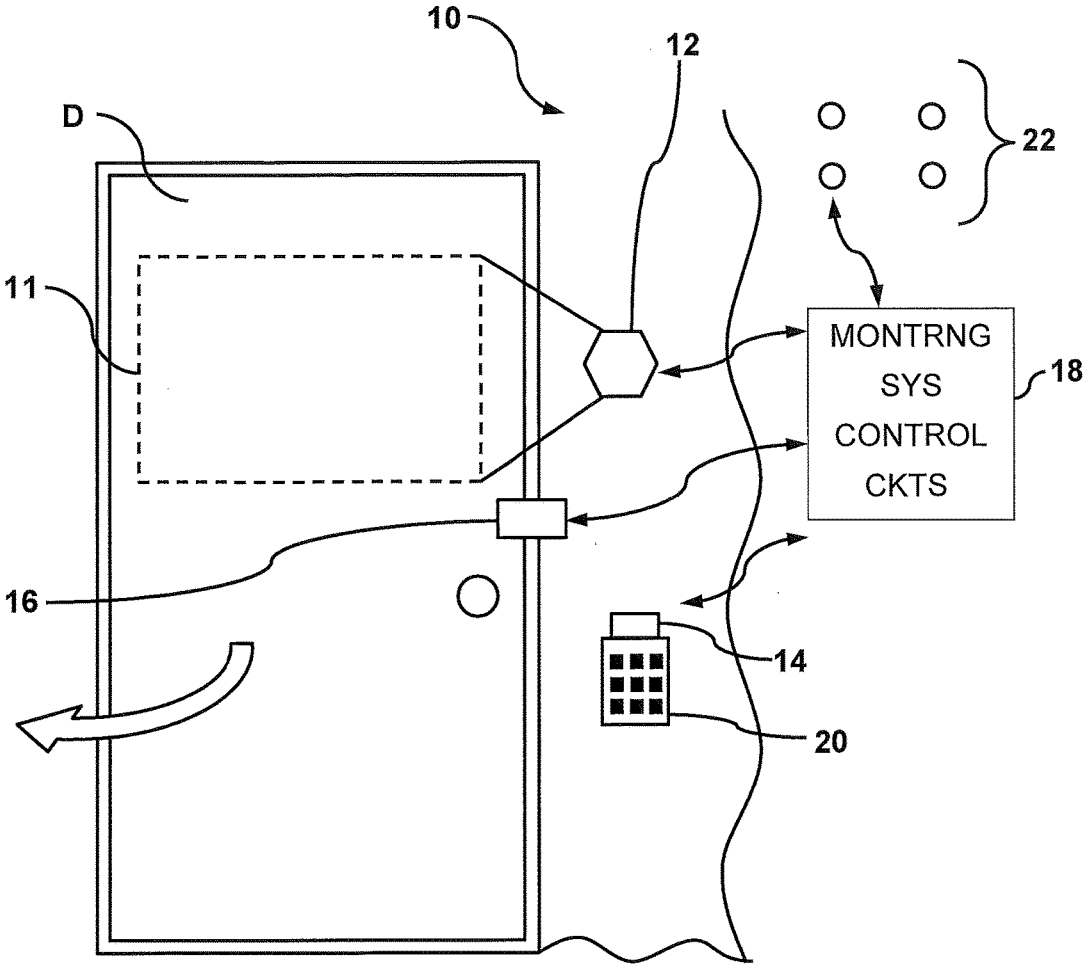
FIG. 1 is a block diagram illustrating a schematic view of a system according to embodiments set forth herein.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As presented herein, embodiments of the subject invention are directed to a security detection and control system and method that can detect, process, and respond to a combination of visual and audible input. Although such visual and audible inputs are generally described herein as being face and voice recognition features, it will be understood by persons of ordinary skill in the art that embodiments of the subject invention are not limited in this regard and can be used in connection with any kind of visual or audible input detection without limitation.

Embodiments described herein can provide for face and voice biometrics fusion identification, which can function as a "Good Guy/Bad Guy Detector." According to such embodiments, at least two basic objectives can be addressed in such a system: (1) continue to ensure the highest confidence in properly authorizing or denying a given individual by conforming to recognized industry and regulatory standards, and (2) maintain a positive user experience by providing quick and convenient means for an authorized individual to disarm an alarm system and gain entry.

With reference now to the figures, FIG. 1 illustrates an exemplary system or apparatus 10 according to embodiments presented herein. The apparatus 10 can include a visual input device 12, such as, for example, a camera or other device for capturing or recording visual images within a field of view 11. The apparatus 10 can further include an audible input device 14, such as, for example, a sensor, detector, or microphone for capturing sound near the field of view 11. The visual and audible input devices 12, 14 can be located adjacent an entryway featuring a door (D) or other type of physical barrier that can move between an opened and closed position to permit or obstruct entry or exit through the entryway. The door (D) can include an access control device 16, such as, for example, a mechanical, electromechanical, or magnetic lock, electric strike, or electronic controller, which can secure the door (D) in the closed position, electronically engage or disengage the access control device 16, or actuate or control the door (D) or physical barrier to open or close.

The visual and audible input devices 12, 14 can be electrically coupled to a monitoring system 18 having one or more control circuits and/or a programmable processor. The monitoring system 18 can be physically located either locally or in a remote location relative the visual and audible input devices 12, 14, can receive an electronic input signal from input devices 12, 14, and can transmit an electronic door control signal to the access control device 16. The monitoring system 18 can be additionally coupled to one or more detectors 22 in other locations throughout the building or facility.

The system 10 can additionally be connected to a manually operable input member 20, such as a keypad, which can allow a user to arm or disarm the monitoring system 18. Additional circuits can also be provided and coupled to the control circuits to evaluate at least one of audible or visual instructions to arm or disarm the monitoring system.

According to embodiments presented herein, the system 10 can include a face recognition processing path (video centric), a voice recognition processing path (audio centric), and a fusion calculator/decision maker. Thus, the control circuits of the monitoring system 18 can implement an authentication process responsive to both visual and audible inputs received from the input devices 12, 14.

In performing this authentication process, the control circuits can receive and recognize a voice command from a subject and at least one visual image of the subject's facial features and can establish scores for the elements of the facial features and voice command. For example, electrical signals from the visual input device can be combined with signals from the audible input device to provide a multi-faceted authentication indicator, which can be compared to a pre-stored rule set by the control circuitry. In one embodiment, for example, the pre-stored rule set can be a set of thresholds. Thus, the control circuits can combine electrical signals from the input devices 12, 14 to enroll authorized subjects and to generate templates of their respective facial features and voice elements.

Figure 2:
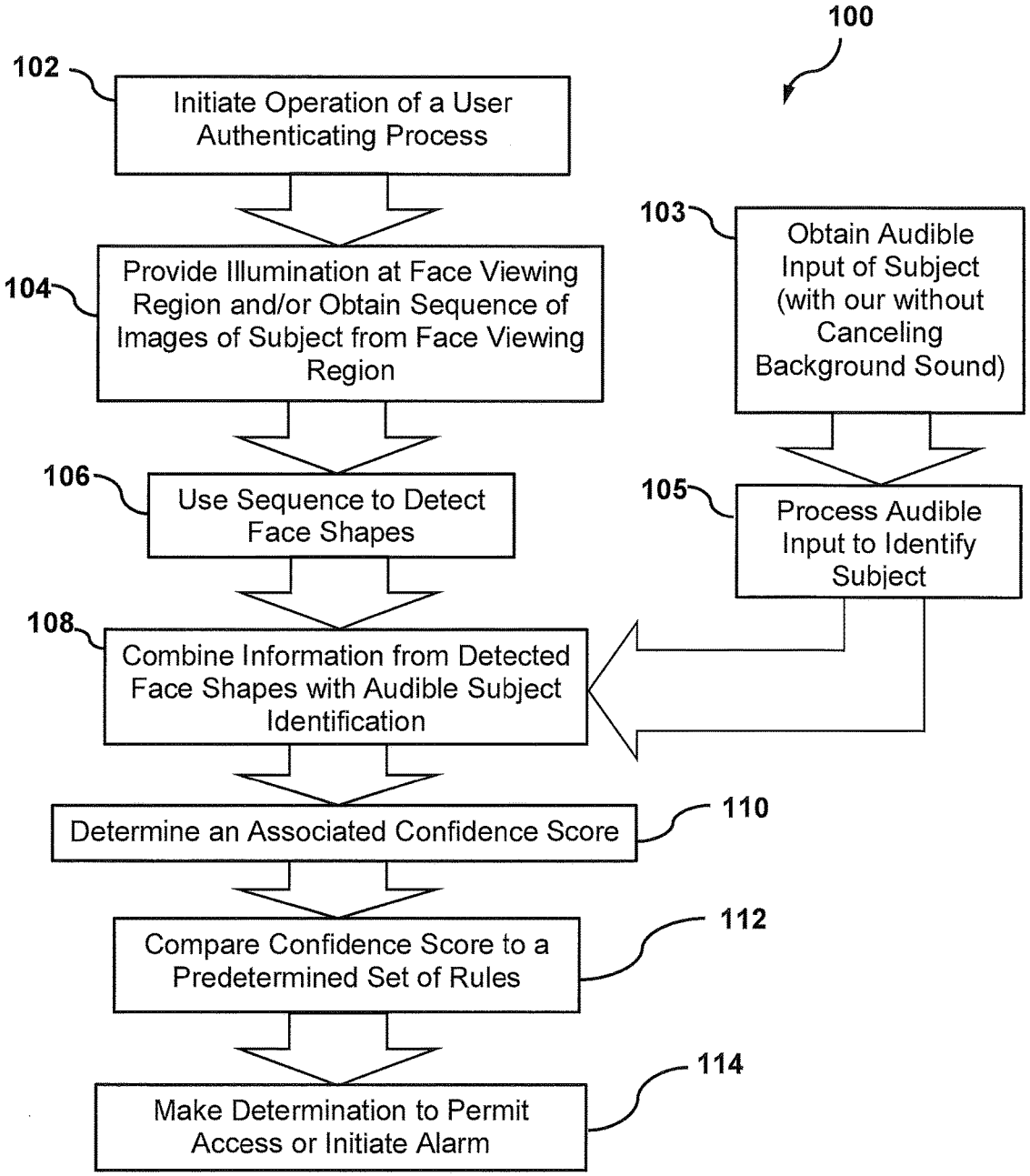
FIG. 2 is a first flowchart illustrating a first method according to embodiments presented herein.

FIG. 2 is a flowchart illustrating an exemplary method 100 for authenticating a subject according to embodiments presented herein. According to the method 100, the system can initiate 102 operation of a user authenticating process in response to one of recognizing a predetermined type of image or receiving an audio trigger. In authenticating the subject, the system can provide 104 substantially constant illumination at a face viewing region and/or obtain a sequence of images of a subject from the face viewing region and use 106 the sequence to detect face shapes. Simultaneously, the system can acquire 103 audio input or signals, such as a pass phrase, from the subject, possibly with background noise cancellation, and process 105 the audio input to detect predetermined audio characteristics for creating a speaker identity score that can be used to detect the subject's identity.

The system can additionally combine 108 information from detected face shapes with an audible speaker identity score from the subject and automatically determine 110 an associated confidence score. According to embodiments of the subject invention, the confidence score can be compared 112 to predetermined thresholds. As a result of this comparison, a determination can be made 114 as to whether to permit access, request additional confirmation, such as a PIN entry, or to initiate an alarm.

Figure 3:
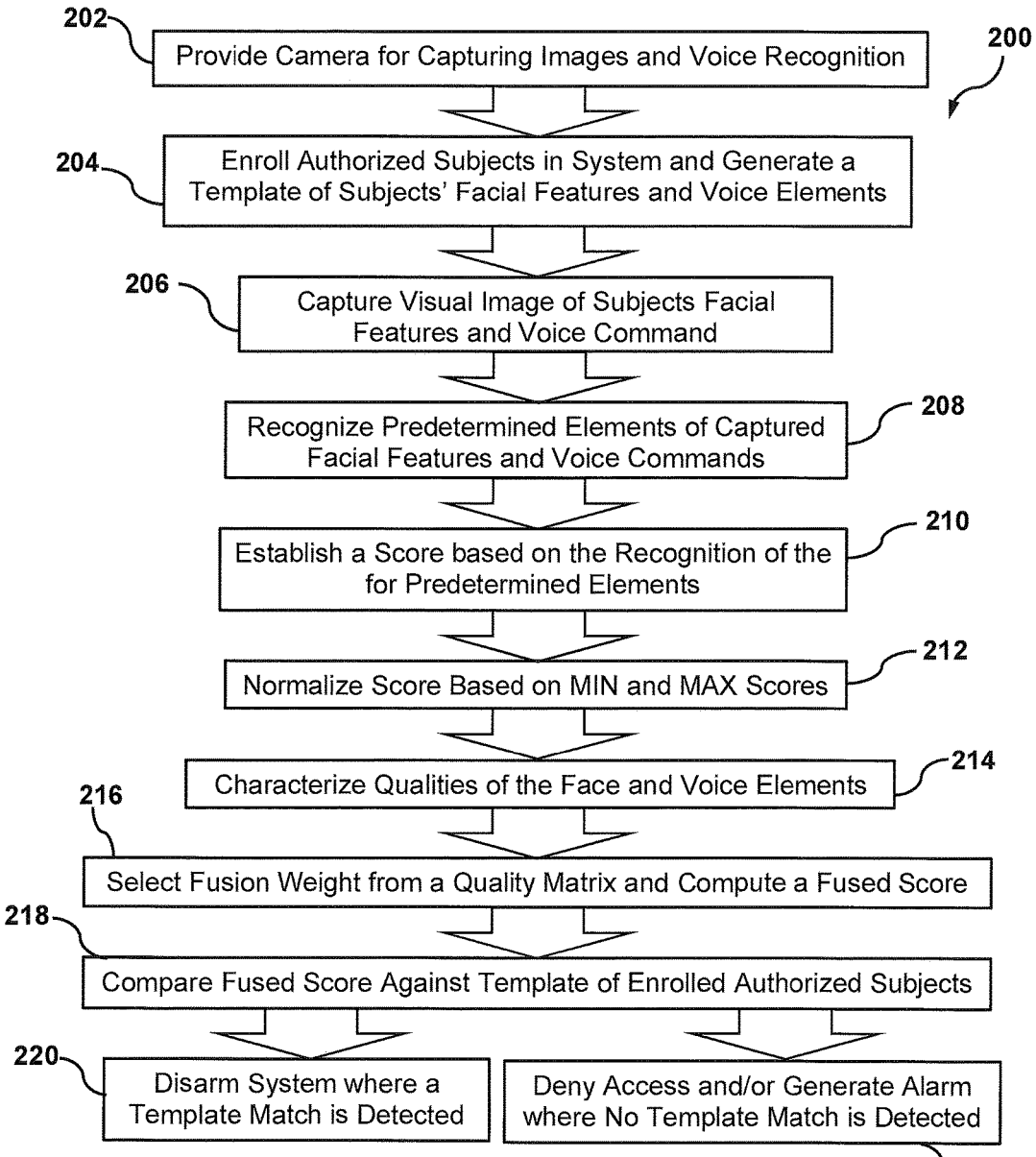
FIG. 3 is a second flowchart illustrating a further method according to embodiments presented herein.

FIG. 3 illustrates further details of a method 200 according to embodiments presented herein. According to this method 200, a detector/sensor unit can be provided having a camera for capturing images and a microphone or acoustic transducer or sensor for capturing voice signals for recognition (text-dependent or text-independent). Authorized subjects can be enrolled 204 in the system by generating a template of their facial features and voice elements. In authenticating a subject, at least one visual image of the subject's facial features and a voice command from the subject can be captured 206, and predetermined elements of the facial features and voice command can be recognized 208.

In processing the captured input, a score for the elements of the captured facial features and the voice command can be established 210 and normalized 212 based on minimum and maximum scores. Based on the face and voice scores, qualities of the face and voice elements can be characterized 214, a fusion weight from a quality matrix can be selected, and a fused score can be computed 216. The fused score can be compared 218 against the template of enrolled authorized subjects. Where a template match is detected, the system can be disarmed 220. Conversely, where a template match is not detected, access can be denied and/or an alarm generated 222.

Meeting industry recognized physical security standards for access control system units of the type presented herein is established by the UL294 standard. UL294 requires an FAR of 1/10,000 (0.01% error) and a FRR of 1/1,000 (0.1% error). Meeting this requirement can be accomplished by employing a combined fusion of facial recognition scores and voice pattern recognition scores. The best face recognition technology today has an error rate of about 1%. The best voice recognition technology today has an error rate of about 10%. However, when combining a confidence score based fusion of face matching and voice matching scores, it has been determined that the desired 1/10,000 FAR and 1/1,000 FRR (99.99% match confidence) can be achieved as required by the security industry and stated in UL294.

Generally, the fusion of face and voice authentication can be based on an adaptively weighed sum of their scores as $$\text{final score}=\text{wt}(i)\times\text{faceScore}+(1-\text{wt}(i))\times\text{voiceScore},$$

where the adaptive weight, wt(i), is determined by the trustworthiness of the scores. The range of scores of a recognition modality can be grouped into multiple regions. One highly trusted region, e.g., having high scores, yields true positive results; another highly trusted region, e.g., having low scores, yields true negative results. One low trust region, e.g., having medium scores, often produces the false rejection and false alarm results. Thus, the uncertain cases that have low trust scores in one modality can be resolved based on the scores of the other modality. Hence, the adaptive weights can be learned from the trustworthiness and statistic properties of the face and voice scores.

The combination of face and voice for authentication can be based on the fusion of scores for face and voice recognition. Many fusion methods, such as MIN, MAX, AND, OR, and SUM of the two scores, exist. They often work well in cases where the recognition modalities perform similarly. On the contrary, performances of face and voice recognitions almost differ in order of magnitude.

Generally, face recognition has been found to be more reliable, and its score should be trusted more. Hence, a weighted sum of the face and voice scores has been tried. This approach applies a fixed weight to all face and voice scores as al score=wt×faceScore+(1−wt)×voiceScore, where wt is the weight for the face score and usually is close to 1.0. This method ignores the impact of performance due to the variations of environmental conditions and results in a suboptimal performance. Methods to adjust the weight depending on the quality of the inputs exist such that inal score=wt(i)×faceScore+(1−wt(i))×voiceScore, where wt(i) is adjusted based on the input quality. The metric for input quality, unfortunately, is not precise and, consequently, the performance of the final score still does not meet the FAR and FRR requirements. Embodiments of the subject invention can still apply a weighted sum method to compute the final score as:

$$\text{final score}=\text{wt}(i)\times\text{faceScore}+(1-\text{wt}(i))\times\text{voiceScore},$$

where the adaptive weight is based on the trustworthiness of the scores.

Score trustworthiness is a metric measuring the confidence that the result is correct as a function of the score. Score results indicate that, when the score is high, a true positive result is almost certain, and, when the score is low, a true negative result is also very sure. When the score is in a mid-range, the occurrence of a false reject and/or false alarm becomes frequent. Hence, the method disclosed herein maps the range of scores into values of score trustworthiness. Score trustworthiness can be discrete or continuous values. The number of partitions can also be adjusted based on the fidelity required to achieve optimal performance.

The face recognition process on a probe can compute a face score and a face trustworthiness score. The voice recognition process on the same probe can similarly compute a voice score and a voice trustworthiness score. Adaptive weights can then be assigned in the fusion formula depending on the face and voice score trustworthiness.

For a large data set, sufficient statistics on the face and voice scores can enable a learning and search algorithm to partition the score space into groups of score worthiness and can determine the adaptive weights such that the required FAR and FRR are achieved.

As described herein, a device and method that can employ confidence score based fusion of face ID scores and voice ID scores for the arming or disarming of an intrusion detection alarm system are new and different.

In addition, it is believed that embodiments described herein are distinguishable over other known methods and improve the performance and operation of such a face and voice biometrics arm/disarm systems in that they can provide for the following.

1. Preconditioning of both face and voice inputs to counter variations in operating environments by containing signal preconditioning post video and audio signal capture to ensure that quality face and voice samples are compared.
2. Noise cancellation and background sound reduction with continuous background sound monitoring by use of selective and judiciously applied spectral audio filtering to concentrate on the human voice signal and suppress ambient noise without adversely affecting distinguishing voice tonal qualities.
3. Employment of active noise cancellation (ANC) techniques for human voice capture and ambient noise suppression by use of multiple microphones with time-phase subtractive feedback noise suppression to preserve accurate near-field audio capture while suppressing background noise.
4. Pre-screening and rejection of nonsense or high noise voice audio samples prior to fusion calculation.

By nature of its higher biometric ID confidence, face scores according to embodiments presented herein can be heavily weighted over voice scores in the overall fusion calculation. Without further correction for high background noise, a user speaking "gibberish," or having someone mimic another's voice, an overly face weighted fusion score may indeed still pass an individual on a face score alone while having illogical voice (audio) input. While statistical confidence is mathematically maintained, such behavior may reduce the perceived confidence of such a biometrics ID system. To mitigate this effect and prior to fusion calculation, a voice (audio) pre-qualification step can be utilized which ensures only logical voice samples proceed to scoring and are presented to the fusion calculation. This can ensure logical and predictable security behavior in the presence of illogical audio input.

5. Dynamic learning and updating of an enrollee database for long term performance enhancement and continuous recognition of physical changes of enrollees.

A biometrics matching ID system can be made more adaptive to long term changes in user appearance (e.g., aging, hair style, facial hair, glasses) by feeding back into the reference database recent match samples that have been determined to be of high capture quality and have high match scores. The database for that authorized user could contain the top three match score samples, for example. This can have the effect of significantly increasing authentication performance at a slight increase in FAR performance.

6. Individual pass phrases for each enrollee, wherein a pass phrase may include selections from a pool of recommendations.

Since embodiments presented herein can compare a sampled pass phrase with a stored reference phase, enrollee pass phrases need not be exactly the same. In fact, user ID phrases can be unique to a given individual and enhance personal identification.

7. Phrase interpretation for actionable commands (e.g., "system arm" or "system disarm") by employment of co-sited voice command recognition in addition to voice pattern matching to affect pre-determined actions based on spoken commands.
8. Nearby human face detection or a voice trigger phrase to start an authentication session.

According to subject embodiments, there can be at least two ways to begin a user authentication session so that the system is not always trying to lock onto random video and audio input stimulus. The first and default method can be for the device to be always on and look for and recognize that a human face is presented directly in front of the camera. Once a human face is detected, an authentication session can begin. The second method can employ a voice trigger phrase to begin an authentication session. This second method could save more power in between usages, but may require the user to first prompt the system to begin.

9. Active lighting (LED) providing consistent illumination of a subject's face despite varying ambient lighting conditions by providing a supporting visible LED or near-IR LED lighting to ensure consistent face illumination regardless of ambient lighting conditions.
10. Human live detection based on contextual and neighboring sequenced images.

Live detection prevents any spoofing and fraud attempts using photo and recorded voice. The live detection approach can be based on analyses in a sequence of images captured while the probe is speaking the pass phrase. In one embodiment, such methods can detect face shape and extract structural and facial key points, e.g., the mouth corners, of the sequential images. The method can then analyze the variations in location and motion as well as similarity to speaking patterns. In addition, a simple frame difference and facial key point registration analysis across frames can also improve the live detection performance.

Disclosed devices and methods can include a face recognition processing path (video centric), a voice recognition processing path (audio centric), and a fusion calculator/decision maker. Captured face and voice samples can be compared to pre-enrolled samples in a local enrollee biometric database. The resulting face matching scores and voice matching scores can then be combined in an inversely weighted manner, and contribution coefficients can be determined by the quality of the respective face and voice match scoring (confidence score based fusion). The overall resulting match score can be compared to a threshold. Users having a match score exceeding the threshold can be authenticated, allowed to disarm the alarm system, and gain entry to the premises. Those who do not meet the authentication threshold can be denied entry, and an alarm request can be generated to the alarm control panel.

Embodiments disclosed herein can replace and/or augment a traditional alarm keypad within a residential home or MDU/apartment. For example, a face ID device can be mounted at about head height (~5.5 ft) on a wall just inside of the main entrance of a home. The biometric ID technology can be embedded within a high end graphics keypad or as a separate aftermarket device mounted next to a standard alarm keypad.

In use, where the system recognizes an identified "Good Guy," the alarm system can be disarmed upon entry to the premises. A "Bad Guy" who is not able to be identified by the system can trigger the control panel to issue an alarm signal. Upon entry, the "Good Guy" can present his/her face and speak a command, such as, for example, "System Disarm," or manually press a "Disarm Stay" key at a keypad as a backup method. Upon exiting the premises, the "Good Guy" can present his/her face to the device and speak a command, such as, for example, "System Arm," or manually press an "Arm Away" key as a backup method. Thus, if the subject wants to be granted access to the premises, then the subject is expected to be entirely cooperative.

The face ID device can be additionally programmed or designed to detect a subject's facial characteristics at various distances from the subject, including, for example, where the subject is within a 1 to 4 ft. range of the ID device. In addition, the response time to recognize and process a subject at the door can be set or designed to be 1 to 2 seconds, which can be significantly lower than current keypad arm/disarm methods (4 digit PIN+Arm/Disarm key).

The performance level of the system and method disclosed herein can meet normative industry access control standards, such as UL294—requiring false acceptance rates (FAR) in the 1/10,000 range or with 99.99% confidence. In addition, false rejection rates (FRR) can occur in the 1/1,000 range or with 99.9% confidence. Such performance levels combined with unmatched ease of use can replace existing 4 digit PINs entered at the alarm keypad.

Embodiments of the subject invention can additionally include supporting co-verification technology(ies), which provide added security without impeding user ingress/egress flow or compromising the enjoyment of the user experience. An additional benefit is that the system and method provide for "hands free" operation, which can be highly beneficial where a user is wearing gloves or carrying packages while passing thru the door. Although speaker dependent voice pattern ID is presently viewed as the most suitable co-verification method at this time, it will be understood that embodiments of the subject invention can employ other similar methods of voice recognition without departing from the novel scope of the subject invention.

User biometric data extraction and database matching can be performed entirely locally within the device or can be carried out at a remote location; although on-line (Internet/Cloud) based processing or database searching is presently prohibitive as it requires multiple external dependencies. However, as such technology adapts and improves it can be more effectively incorporated herein. In addition, embodiments disclosed herein can carry out "selected list" processing. For example, the local biometric database can be limited to those who are entitled unrestricted access (enrolled) to a particular home or small business, which is usually 12 people or less. Everyone else not enrolled in the local database can be viewed as a potential intrusion threat and can be subject to generating an alarm.

The face ID PoC prototype of the subject invention can support new user enrollment into a local database, which is flexible and maximizes a positive user experience. That is, to say such a prototype can minimize user time and physical interaction required with the device. The entire enrollment and approval process can be performed using local processing resources that take on the order of 1 to 2 minutes. In addition, once the local user database limit is reached, the system can overwrite the oldest enrolled users as a preferred fault mechanism. The system can incorporate a SNAP sensor camera and/or standard CMOS camera technology.

Enrollment can require an authorized sponsor to approve subsequent user enrollments by using a master user PIN or having a master user present his own pre-authorized face and voice pattern to the device. For simplicity and time, the enrollment and approval process can alternatively default to being always authorized.

Additional examples of system characteristics and performance analytics can include, for example, the following.

SWAP targets on the order of: core processing module <~6 sq./in. (~2"×3"), weight <4 oz., power: <1 W Operating environment: conditioned indoor environment (commercial temp. spec.)

Lighting environment: wide variation in lighting environment expected, including possible strong backlight ID performance: UL294, 99.99% FAR, 99.9% FRR ID response time: 1-2 seconds, max: <3 seconds User enrollment time: under 1 minute, max: under 2 minutes Outputs: face present/not present and match/no match The face ID protocol of the subject invention can additionally be performed in connection with various other technologies, including smartphones, tablets, PDAs, and web cameras with video capture drivers. Such technologies generally are well supported by biometric programs, provide optimal user feedback, provide a rich GUI environment, have a self-contained demonstration platform that easily ships to required locations, and have a well-supported application development environment, which can quickly and efficiently provide remote patches/updates. Such technologies can additionally utilize face and voice authentication applications or programs.

The face detector can also be converted to an integer based detector that can be faster for an embedded system, and a glass detector can be provided to improve the quality and the matching of faces. Subject embodiments can further include a landmark detector to better localize certain facial landmarks by evaluating several detections and not just the maximum detection. A pose estimator can also be provided to select the best frontal poses or reject off-angle poses.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, steps may be eliminated from the described flows, and other components may be added to or removed from the described embodiments.

What is claimed is:

1. An apparatus comprising:

a monitoring system that includes control circuits;

a visual input device coupled to the control circuits; and an audible input device coupled to the control circuits, wherein the control circuits (1) enroll a plurality of authorized subjects, (2) generate a template of facial features and voice elements for each of the plurality of authorized subjects, (3) assign a facial score to an image captured by the visual input device based on facial recognition, (4) assign a vocal score to audio captured by the audible input device based on voice pattern recognition, (5) compute a facial trustworthiness score and a vocal trustworthiness score based on the facial score and the vocal score, (6) normalize the facial score and the vocal score based on minimum and maximum scores, (7) select a fusion weight from a quality and trustfulness matrix and compute a fused score, (8) compare the fused score against the template, (9) disarm the monitoring system when a template match is detected, and (10) deny access when the template match is not detected.

2. The apparatus as in claim 1 wherein electrical signals from the visual input device are combined with the electrical signals from the audible input device to provide a multi-faceted authentication indicator.

3. The apparatus as in claim 2 wherein the control circuits determine actionable commands based on comparisons of the multi-faceted authentication indicator to a set of decision rules.

4. The apparatus as in claim 1 further comprising a manually operable input member to arm or disarm the monitoring system.

5. The apparatus as in claim 4 further comprising additional circuits coupled to the control circuits to evaluate audible or visual instructions to arm or disarm the monitoring system.

6. The apparatus as in claim 1 wherein the control circuits progressively update the template of the facial features and the voice elements for each of the plurality of authorized subjects to account for physical changes of the plurality of authorized subjects and background changes.

7. The apparatus as in claim 1 wherein the control circuits receive the image and a voice command from one of the plurality of authorized subjects.

8. The apparatus as in claim 7 wherein the control circuits recognize facial elements of the facial features and the voice elements of the voice command of the one of the plurality of authorized subjects.

9. The apparatus as in claim 8 wherein the control circuits characterize qualities of the facial elements of the facial features in the image and the voice elements of the voice command based on the facial score and the vocal score.

10. A process of authenticating a subject comprising:

enrolling the subject;

generating a template of facial features and voice elements for the subject;

initiating operation of a user authenticating process in response to one of recognizing a predetermined type of image or receiving an audio trigger;

obtaining a sequence of images of the subject from a face viewing region;

using the sequence of images to assign a facial score based on facial recognition;

obtaining an audible input from the subject;

processing the audible input to assign a vocal score based on voice pattern recognition;

computing a facial trustworthiness score and a vocal trustworthiness score based on the facial score and the vocal score;

normalizing the facial score and the vocal score based on minimum and maximum scores;

selecting a fusion weight from a quality and trustfulness matrix and computing a fused score;

comparing the fused score against the template;

disarming a monitoring system when a template match is detected; and denying access when the template match is not detected.

11. The process as in claim 10 further comprising comparing the fused score to a predetermined set of rules.

12. The process as in claim 11 wherein, responsive to results of comparing the fused score to the predetermined set of rules, determining if the access should be provided, further credentials from the subject should be requested, or an alarm should be initiated.

13. The process as in claim 10 wherein disarming includes receiving a visual input or the audible input and generating a disarm command.

14. The process as in claim 13 further comprising receiving a manually operable input for generating the disarm command.

15. The process as in claim 10 further comprising characterizing qualities of facial elements of the facial features in the sequence of images and the voice elements in a voice command based on the facial score and the vocal score.

16. A method of using biometric identification for disarming an alarm system comprising:

providing a detector/sensor unit having a camera for capturing images and text-dependent voice recognition;

enrolling a plurality of authorized subjects;

generating a template of facial features and voice elements for each of the plurality of authorized subjects;

progressively enhancing the template to account for physical changes of the plurality of authorized subjects and background changes;

capturing a visual image of facial features and a voice command from an individual;

recognizing face and voice elements of the facial features and the voice command of the individual;

establishing face and voice scores and trustfulness for the face and voice elements of the facial features and the voice command;

normalizing the face and voice scores based on minimum and maximum scores;

characterizing qualities of the face and voice elements of the facial features and the voice command based on the face and voice scores;

selecting a fusion weight from a quality and trustfulness matrix and computing a fused score;

comparing the fused score against the template;

disarming the alarm system when a template match is detected; and denying access when the template match is not detected.

* * * * *